United States Patent [19]

Luperti et al.

[11] 3,977,222

[45] Aug. 31, 1976

[54] LOCKING DEVICE

[75] Inventors: Harry E. Luperti, Wilton; Lawrence J. Kresan, Stamford, both of Conn.

[73] Assignee: Pitney-Bowes, Inc., Stamford, Conn.

[22] Filed: Aug. 22, 1975

[21] Appl. No.: 606,965

[52] U.S. Cl. ..... 70/292; 70/314; 70/315; 70/333 R

[51] Int. Cl.[2] ..... E05B 37/12; E05B 37/16

[58] Field of Search ..... 70/286, 287, 288, 291, 70/292, 293, 304, 312, 314, 315, 316, 333

[56] References Cited

UNITED STATES PATENTS

| | | | |
|---|---|---|---|
| 2,706,393 | 4/1955 | Jamieson et al. | 70/293 |
| 2,967,419 | 1/1961 | Katona | 70/288 |
| 3,115,028 | 12/1963 | Windle | 70/288 |
| 3,664,231 | 5/1972 | Hanson | 70/292 |
| 3,869,885 | 3/1975 | Uthenwoldt | 70/315 |

*Primary Examiner*—Roy D. Frazier
*Assistant Examiner*—Thomas J. Holko
*Attorney, Agent, or Firm*—William D. Soltow, Jr.; Albert W. Scribner; Robert S. Salzman

[57] ABSTRACT

An improvement in a locking device of the type having a series of reference combinations arranged serially upon a tape. A combination is entered into the system by a set of push buttons. The combination entered is compared with the reference combination. If both combinations are complementary, the system can be unlocked. The improvement prevents the unauthorized ascertainment of the combination needed to release the device. An isolation or restraining bar acts as a buffer between an internal gate and a set of tumbler levers. When an actuator knob is turned to unlock the system, the tumbler levers normally will engage with the gate when the combination push buttons are not set to the proper combination. The combination then becomes ascertainable, because the tumbler levers that require actuation, transmit movement to the push buttons when contacted by the gate. The isolation or restraining bar prevents the gate from engaging with the tumbler bars, thus preventing unauthorized ascertainment of the combination required to release the locking device.

7 Claims, 2 Drawing Figures

LOCKING DEVICE

This invention pertains to an improved locking device of the type having a reference combination disposed upon a tape, which reference combination is compared with an entered combination to provide a release of a lock.

PRIOR ART

The invention relates to an improvement over the prior locking systems depicted in U.S. Pat. Nos. 3,869,885, issued Mar. 11, 1975; and 3,664,231, issued May 23, 1972.

As otherwise described herein, the present invention is constructed and operates in the like fashion to that shown in these prior patents.

BACKGROUND OF THE INVENTION

Heretofore, it was possible to obtain the internal combination of the tape locking device of the type disclosed in U.S. Pat. No. 3,664,231. By attempting to turn the actuating knob, one could observe that certain of the external combination push buttons moved. It was further noted, that it was these same buttons, which were needed to be depressed to release the system.

This invention is concerned with eliminating any feed-back through internal linkages, and with the unauthorized obtaining of the internal combination of the subject locking device through such feed-back.

SUMMARY OF THE INVENTION

The invention relates to an improvement in the prior locking device described in U.S. Pat. Nos. 3,869,885 and 3,664,231.

The improvement prevents unauthorized ascertainment of the combination needed to release the device. An isolation or restraining bar is disposed adjacent each of the internal gates of the device. Each bar acts as a buffer between the gate and a set of tumbler levers. Normally, when the actuator knob is turned to release the system, the gates move inward. If the correct combination has not been entered into the system, certain ones of the tumbler levers will block the inward movement of the gates. It is these tumbler levers that need depressing by the external combination setting push buttons.

In the prior devices, the engagement of the tumbler levers with the gate caused a feed-back through the internal linkage. This feed-back resulted in moving the push buttons required to release the device. Thus, the combination needed to unlock the device could be obtained in an unauthorized fashion.

The present invention prevents this feed-back by isolating the tumbler levers from the gates. The isolation or restraining bar prevents the gate from coming in contact with the tumbler levers when the push buttons are not set to the proper combination.

In effect, the gates are no longer directly restrained by the tumbler levers, but rather by the isolation bars.

When the tumbler levers assume their proper combination positions, the isolation bars cease to restrain the gates, allowing for release of the locking device.

The isolation bars are held in restraining engagement with the gates by the improperly set tumbler levers, and pivot to release the gates when the tumbler levers achieve the correct combination.

It is an object of this invention to provide an improved locking device of the type having a reference combination disposed upon a tape.

It is another object of the invention to provide apparatus for preventing unauthorized ascertainment of an internal combination of a locking device as described in U.S. Pat. No. 3,664,231.

These and other objects of this invention will become more apparent and will be better understood with reference to the following detailed description taken in conjunction with the attached drawings, in which:

FIG. 1 is a perspective view of the subject locking device with the inventive improvement; and FIG. 2 is a cross-sectional front view of the invention shown in FIG. 1.

DETAILED DESCRIPTION

Generally speaking, the invention is for a combination locking device of the type having a tape containing a plurality of serially disposed predetermined reference combinations. The tape is advanced to a new reference combination position for each unlocking operation performed upon the device. A new combination is entered into the device by a set of depressible keys. A new combination is entered for each unlocking operation. The entered combination must complement each new reference combination advanced on the tape and set into the device by depressible internal fingers, in order to unlock a lock of the device. Keys are movable between a depressed and non-depressed position to enter a combination. The internal fingers are depressed or remain non-depressed to set the reference combination. The invention comprises an operative means for moving a gate from a locking position to an unlocking position. A set of tumbler levers are disposed adjacent the gate. Each tumbler lever is settable between four positions; a first and second position for the depressed and non-depressed finger conditions. The tumbler levers provide for the setting of the entered combination into the device. The tumbler levers allow the gate to move from the locking position when the entered combination complements the reference combination. The tumbler levers, otherwise operatively restrain movement of the gate from the locking position. An isolation or restraining means is operatively disposed between the tumbler levers and the gate. The isolation or restraining means serves two separate purposes: (1) It prevents the engagement of the gate with the tumbler levers when the operative means is actuated and the tumbler levers are positioned to provide a non-complementary entered combination with respect to the reference combination, and (2) It is engageable with the gate for preventing the movement of the gate from its locking position. The isolation or restraining means is movable between a restraining gate position, and a freeing gate position in response to the position of the tumbler levers. The isolation or restraining means is in the restraining gate position when the tumbler levers provide a non-complementary entered combination with respect to the reference combination.

It is to be noted that the full description of the locking device has been previously given in U.S. Pat. Nos. 3,869,885 and 3,664,231. For the sake of brevity, and to prevent confusion, the present invention will describe only those features, parts, apparatus, and operations that are new, or otherwise modify the previous systems. It is to be understood that all apparatus and functions of this invention are identical with those previously described, unless otherwise stated herein.

Figure 1:
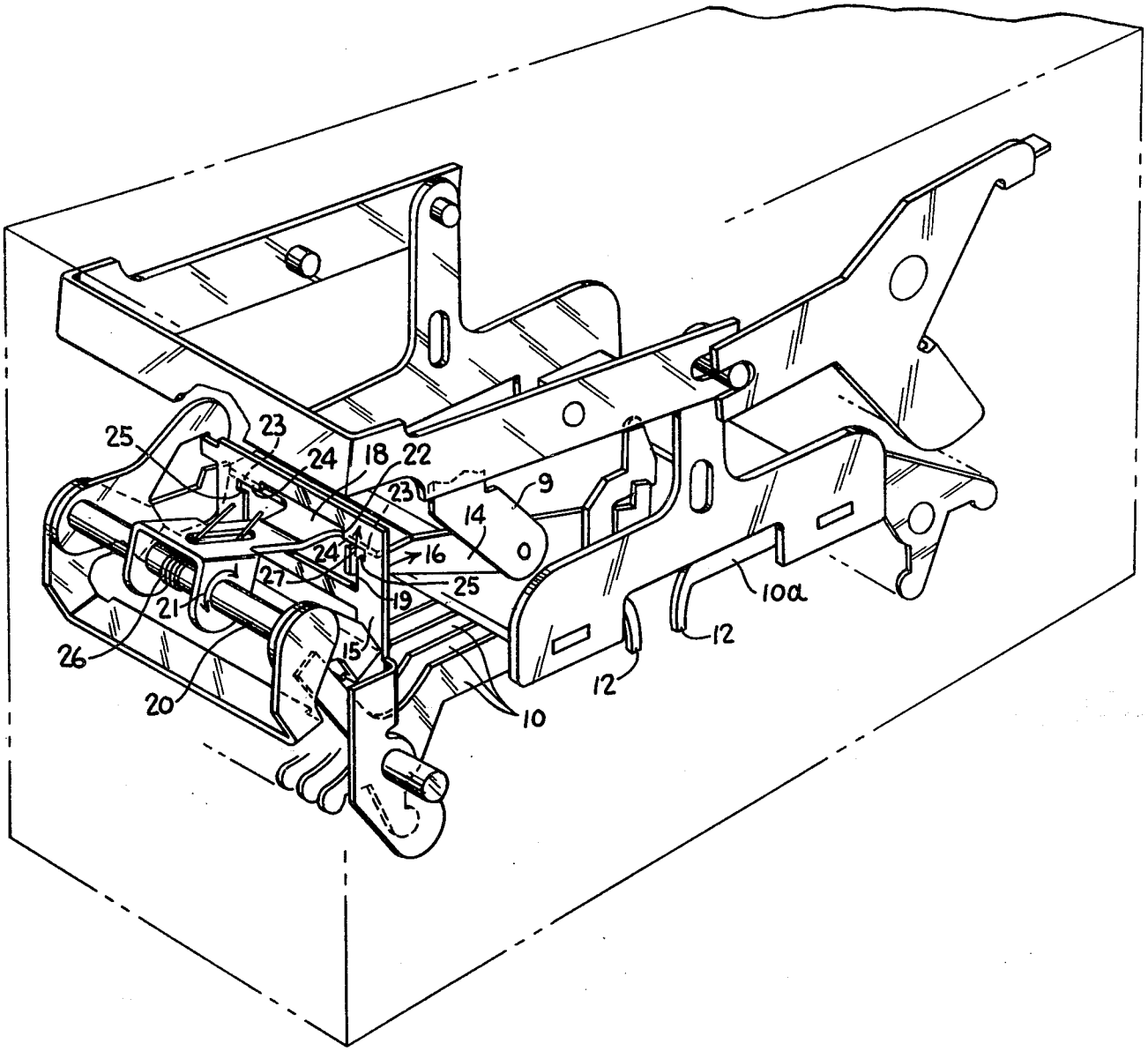
Figure 2:
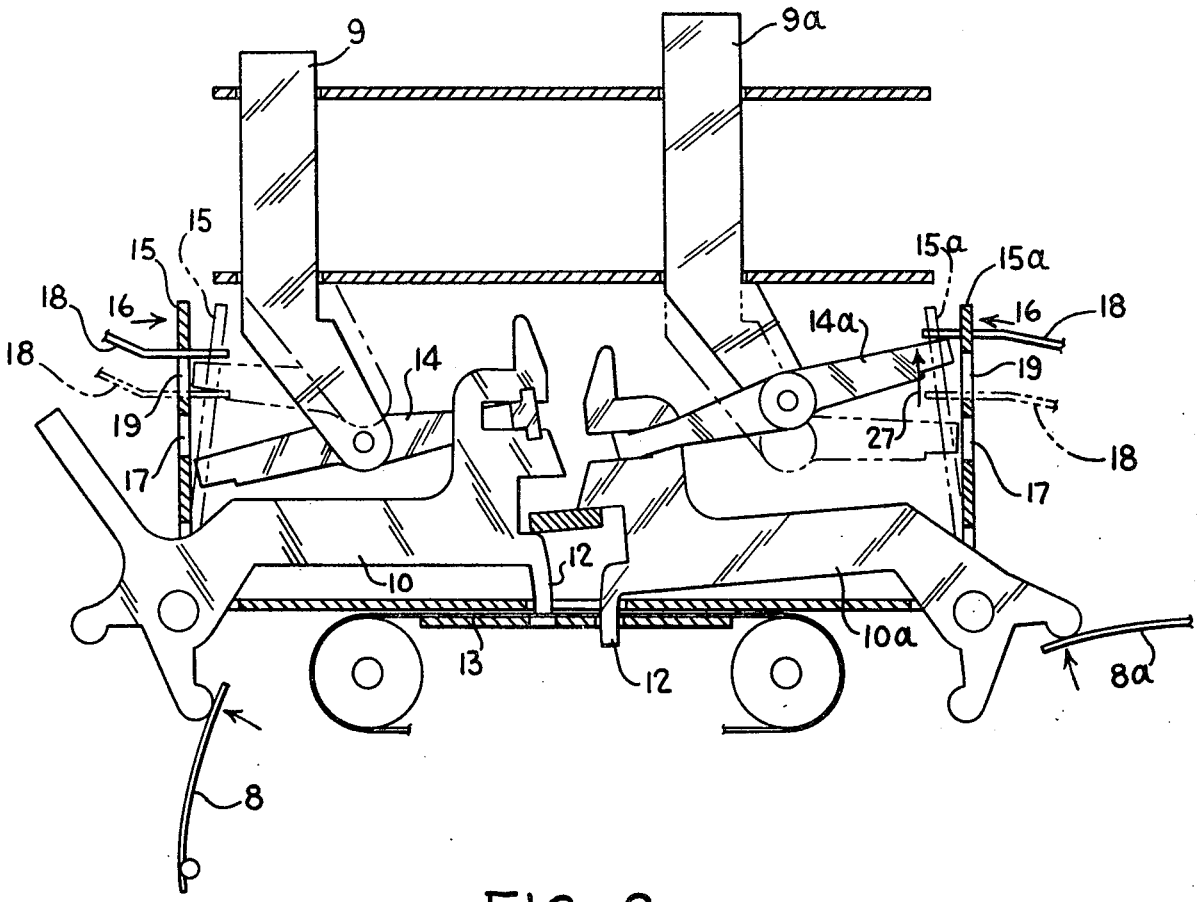

Now referring to FIGS. 1 and 2, a perspective and an internal sectional view of the invention is shown, respectively.

The locking device has two sets of fingers 10 and 10*a*, respectively. These fingers are spring-biased by springs 8 and 8*a*, respectively, so that their finger tips 12 are always tending to drop through holes in the tape 13. Of course, if no hole exists for any particular finger, that finger will not drop through. FIG. 2 illustrates the two possible finger positions. Finger 10a (on the right) has dropped through a hole in the tape, while finger 10 (on the left) remains above tape 13 (no hole). Fingers 10 and 10*a* set a new reference combination into the device for each unlocking operation. A knob (not shown) is cranked for each unlocking operation. This advances the tape 13 to a new reference combination, and forces the gates 15 and 15*a* to move inwardly as depicted by the arrow 16, and the inward gate position shown in phantom in FIG. 2.

The reference combination having been set by fingers 10 and 10a, respectively, the matching entered combination is set by depressing keys 9 and 9*a*, respectively.

When keys 9 and 9*a* are depressed, corresponding tumbler levers 14 and 14*a*, respectively, are caused to assume a second position. In the case where the finger 10*a* has projected through the tape 13 (righthand side of FIG. 2), the key 9*a* must be depressed so that tumbler lever 14*a* will assume a position which will allow it to pass through window 17 in gate 15*a* (phantom line position). If the key 9*a* is not depressed, the tumbler lever 14*a* will remain in the upper position shown in solid line. In this upper position, the tumbler lever 14*a* will support a restraining (isolation) bar 18 in an upward position, which in turn holds gate 15*a* from moving inwardly (arrow 16).

In the case where there is no hole in the tape for a finger to drop through (lefthand side of FIG. 2), depressing the key 9 will result in moving tumbler lever 14 to a gate blocking position depicted by the solid lines. As will be seen, in the blocking position, tumbler lever 14 will not pass through window 17 in gate 15. The phantom lines illustrate a tumbler lever position which results from allowing key 9 to remain non-depressed. In this position, the tumbler lever 14 will pass through gate 15 via window 19.

It should be understood, that each of both sets of keys 9 and 9*a*, respectively, will have a combination of depressed and non-depressed keys necessary to complement those positions set by the reference fingers 10 and 10*a*. The two different positions for the fingers of FIG. 2 are only an explanatory example of how either of the fingers in each set may be positioned. In other words, each finger in each set may be in a depressed or a non-depressed position, and each tumbler lever may assume one of four distinct positions depending upon the finger position.

As aforementioned, when a tumbler lever needs to be depressed to complement its corresponding finger (right hand side of FIG. 2) the tumbler lever will support the restraining (isolation) bar 18 (arrow 27). The addition of this bar 18 to the locking device is the subject of this invention.

OPERATION OF THE INVENTION

As will be seen with reference to FIG. 1, the restraining or isolation bar 18 has a general T-shaped appearance. The restraining bar 18 is pivotable about shaft 20 (arrows 21), and pivots between a restraining gate position and a freeing gate position. The solid lines of FIG. 2 (right hand side) depict the restraining gate position for bar 18, while the phantom lines depict the freeing gate position of bar 18.

In the restraining position, bar 18, will hold the gate (15 or 15*a*, as the case may be) from moving from its outer locking position, to its inner (arrow 16) unlocking position (see the solid and phantom lines respectively, of FIG. 2).

The bar 18 restrains the gate 15 (FIG. 1), when one of the tumbler levers is supporting (arrow 27) bar 18. This causes bar 18 to snap into upper groove 22 in window 19.

As will be seen in FIG. 1, the gate 15 will not be able to move inwardly, when the bar 18 is in the groove 22. This is so, because the T sections 23 will get caught behind lip 24 of groove 22.

Bar 18 is spring-loaded downwardly about shaft 20, due to spring 26. Therefore, when all the tumbler levers 14 assume their proper complementary position, bar 18 will be free to move downwardly. This will result in allowing the gate 15 to pass bar 18 via groove 25. Groove 25 is wider than groove 22, allowing T sections 23 to pass through.

Of course, when all the tumbler levers 14 are in the proper complementary position for allowing the gate to pass bar 18, the levers themselves are in the proper positions to pass through windows 17 or 19 in the gate. Thus, the gate is free to move inwardly (arrow 16).

The restraining or isolation bars 18 serve two separate purposes over the prior systems:

a. The bars 18 prevent contact of the tumbler levers 14 and 14*a* requiring depressing, with gates 15 and 15*a* respectively. This isolation prevents the ascertainment of the entering combination in an authorized fashion, because the gates never contact the tumbler levers which need to be depressed. As aforementioned, it was the gate contact with these tumbler levers when the knob was turned, that was transmitted back to the keys 9 and 9*a*. By observing those keys which jiggled, one would have been able to observe which keys needed depressing, without having to obtain the combination from Postal Authorities.

b. The bars 18 themselves now act to restrain the gate 15 in addition to the tumbler levers 14. Therefore, the bars 18 act in a dual capacity to prevent the unauthorized unlocking of the locking device.

Of course, it will be understood that other means of isolating the gate and tumbler levers can be designed into this device now that the inventive problem has been recognized. Therefore, it is to be understood that the scope and spirit of the invention should not be unduly limited by the specific inventive design depicted in the drawings. The drawings are meant to be exemplary in nature, and only as a means of explaining one way of carrying forth the inventive purpose.

What is claimed is:

1. A combination locking device of the type having a tape containing a plurality of predetermined reference combinations serially disposed thereon, said tape being advanced to a new reference combination position for each unlocking operation performed upon said device, a new combination being entered into said locking device for each unlocking operation, which newly entered combination being required to complement a new predetermined reference combination which has been advanced upon said tape in order to unlock a lock of said locking device, the combination locking device comprising:

operative means for moving a gate of said device from a locking position to an unlocking position;

a gate operatively connected to said operative means and movable between said locking and unlocking positions in response to actuation of said operative means;

a set of tumbler levers disposed adjacent said gate, said levers each being settable between a complementary position and a non-complementary position so as to provide for the setting of the entered combination into said device, said levers allowing movement of said gate from said locking position when the entered combination complements the reference combination, the tumbler levers otherwise operatively restraining movement of said gate from said blocking position; and isolation means operatively disposed between the tumbler levers and said gate for preventing engagement of the gate with said tumbler levers, when said operative means is actuated and when said tumbler levers are positioned to provide an entered combination that is non-complementary with said reference combination.

2. The combination locking device of claim 1, wherein said gate has a window through which said tumbler levers can pass when said operative means is actuated and when said tumbler levers are positioned to provide an entered combination that is complementary with said reference combination.

3. The combination locking device of claim 1, wherein said isolation means comprises a restraining bar that is engageable with said gate and is movable between a gate restraining position and a freeing gate position, said restraining bar preventing movement of the gate into engagement with the tumbler levers when said restraining bar is in a gate restraining position when said tumbler levers are positioned to provide an entered combination that is non-complementary with said reference combination.

4. The combination locking device of claim 3, wherein said restraining bar is biased towards the freeing gate position.

5. The combination locking device of claim 3, wherein said restraining bar has a T-shaped appearance.

6. The combination locking device of claim 3, wherein said restraining bar is pivotably mounted so as to be pivotably movable between said gate restraining position and the freeing gate position.

7. A combination locking device of the type having a tape containing a plurality of predetermined reference combinations serially disposed thereon, said tape being advanced to a new reference combination position for each unlocking operation performed upon said device, a new combination being entered into said locking device for each unlocking operation, which newly entered combination being required to complement a new predetermined reference combination which has been advanced upon said tape in order to unlock a lock of said locking device, the combination locking device comprising:

operative means for moving a gate of said device from a locking position to an unlocking position;

a gate operatively connected to said operative means and movable between said locking and unlocking positions in response to actuation of said operative means;

a set of tumbler levers disposed adjacent said gate, said levers each being settable between a complementary position and a non-complementary position so as to provide for the setting of the entered combination into said device;

restraining means engageable with said gate and movable between a gate restraining position and a freeing gate position, said restraining means for preventing the movement of the gate into the gate unlocking position when said restraining means is in the gate restraining position, said restraining means being in a gate restraining position when said tumbler levers are positioned to provide an entered combination that is non-complementary with said reference combination.

* * * * *